United States Patent [19]

Bron

[11] 4,118,152

[45] Oct. 3, 1978

[54] PUMP FOR VARIABLE DOSING

[76] Inventor: Dan Bron, 36 Palmach St., Haifa 34 558, Israel

[21] Appl. No.: 799,833

[22] Filed: May 23, 1977

[30] Foreign Application Priority Data

Jun. 2, 1976 [IL] Israel ..... 49703

[51] Int. Cl.[2] ..... F04B 21/02; F04B 21/08

[52] U.S. Cl. ..... 417/254; 92/60.5; 417/545; 417/555 R

[58] Field of Search ..... 417/545, 555, 254, 274, 417/275, 276, 277; 92/60.5; 222/282, 381

[56] References Cited

U.S. PATENT DOCUMENTS

| | | | |
|---|---|---|---|
| 851,262 | 4/1907 | Tatum | 92/60.5 X |
| 1,180,857 | 4/1916 | Lefever | 222/381 X |
| 1,511,971 | 10/1924 | Hunter | 417/254 |

FOREIGN PATENT DOCUMENTS

| | | | |
|---|---|---|---|
| 73,278 | 8/1916 | Fed. Rep. of Germany | 417/254 |

*Primary Examiner*—Carlton R. Croyle
*Assistant Examiner*—R. E. Gluck
*Attorney, Agent, or Firm*—Ladas, Parry, Von Gehr, Goldsmith & Deschamps

[57] ABSTRACT

A variable dosing piston pump having a cylinder made of two parts, the fixed part through which the piston rod extends and a part adapted to be inserted more or less within said fixed part and means to fix said parts relative to each other, an outlet in said fixed part for the dosed liquid, an inlet controlled by a non-return valve in said movable part, the piston having a diameter adapted to that of the movable part and comprising a non-return valve. By changing the positions of the two cylinder parts relative each other, and retaining the same piston movement, the effective stroke of the piston is changed, thereby changing the dosing.

4 Claims, 2 Drawing Figures

PUMP FOR VARIABLE DOSING

The invention concerns a linear dosing pump which operates with a fixed stroke and whose dosing can be varied whenever desired.

Dosing pumps are very popular in various technical fields where it is required to ration measured quantities of liquids either during definite time periods or in definite proportions. These pumps are generally linearly operable and are mainly piston pumps.

A change in dosing in these pumps is carried out in two ways:

a. Changing the frequency of the stroke while its length is kept fixed;

b. Changing the length of the stroke while its frequency is kept fixed.

In the first example a driving source with speed regulation is required, and, in the second, a gear train between the motor and the pump. Both examples constitute complicated and expensive solutions, which add to complications in operation and to a reduced accuracy of the dosing arrangement.

It is the object of the present invention to provide a simple, cheap and accurate means for varying the dosing of piston pumps when required.

The invention consists in a variable dosing piston pump having a cylinder made of two parts, the fixed part through which the piston rod extends and a part adapted to be inserted more or less within said fixed part and means to fix said parts relative to each other, an outlet in said fixed part for the dosed liquid, an inlet controlled by a non-return valve in said movable part, the piston having a diameter adapted to that of the movable part and comprising a non-return valve.

The invention is illustrated, by way of example only, in the accompanying drawings in which.

Figure 1:
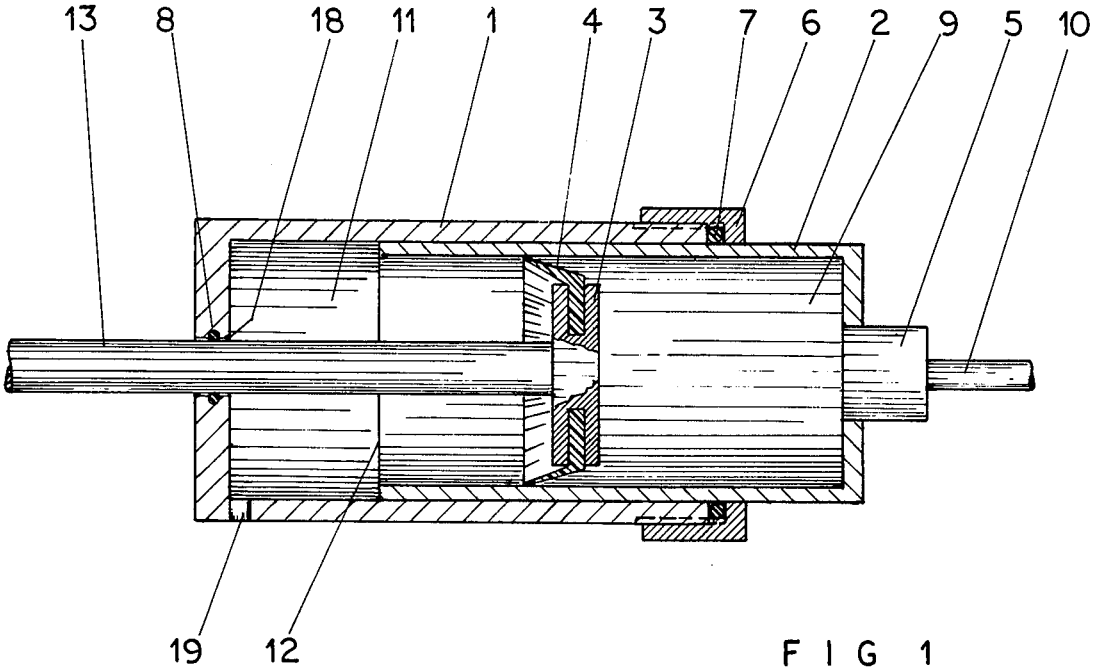
FIG. 1 shows a longitudinal section of a dosage pump according to the invention.

The cylinder of the pump according to the invention is constituted by a fixed cylinder 1 into which the open end of a movable cylinder 2 is inserted. In these cylinders and coaxial therein a piston 3 is reciprocatingly movable, the rod 13 of which extends outwards through aperture 18. A non-return valve 4 constituted by an elastic backwardly extending skirt is mounted on piston 3. A suction valve 5 constituted by a non-return valve of any suitable type is mounted at the closed end of cylinder 2. At the open end of cylinder 1 a flanged annular connector 6 is screwed, which, with the aid of seal 7, seals and fixes the relative position of the two cylinders.

OPERATION

Referring to FIG. 1, let us assume at first that the piston moves in a direction to the right within cylinder 2. The pressure, which develops in the space 9 as a result, closes the valve 5 and prevents the outflow of the liquid to the suction pipe 10. This pressure also causes the valve 4 to open by pressing in axial direction at the periphery of the elastic seal which is removed from the cylindrical surface and permits the liquid to flow to the left of the valve 4 into the space 11.

At the end of the stroke to the right, the piston 3 stops and the movement to the left begins. The pressure in the space 9 falls immediately and as a result valve 5 is opened and new liquid flows in to fill the space 9 which is progressively becoming larger. Owing to the pressure drop in space 9 valve 4 closes, since there now is greater pressure at its left and presses its circumference against the surface of the cylinder. During the stroke to the left, the space 11 is emptied by way of outlet 19. As the piston passes the edge face 12 of the cylinder 2 and moves towards the left, valve 4 no longer seals this cylinder owing to the difference in its diameter and that of cylinder 1, and the pressure from space 11 passes to space 9 and closes the valve 5 immediately, so that suction stops. From this point and leftwards, the stroke of the piston is an idle one and does not contribute to the operation of the pump. Thus the quantity pumped during each pulse relates directly to the effective length of the pump and this is the distance between the end 12 of the cylinder 2 and the outermost point of the stroke of the piston at the right.

A change in dosing is made by a change in the said effective stroke. For this, the connector 6 is unscrewed and the cylinder 2 is inserted into or withdrawn from cylinder 1 for the required distance before the connector 6 is tightened.

It is possible to change the construction of the pump without departing from the scope of the above-described invention.

Figure 2:
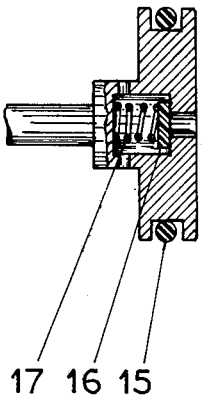
FIG. 2 shows a longitudinal section of a possible piston.

For example, it is possible to separate the function of the valve from that of the seal of the piston, as for example in FIG. 2, which shows a seal 15 and a non-return valve 16,17. The valve may be constructed at any desired point in the area of the piston. The fixed relative position of cylinder 2 to the cylinder 1 can also be changed in various ways such as by means of a screw, which extends vertically through the wall of cylinder 1 and presses on cylinder 2, or by means of screwing one cylinder into the other.

I claim:

1. A variable dosing piston pump having a cylinder, a piston housed in said cylinder and a piston rod attached to said piston, the cylinder being made of two parts, namely a fixed part through which the piston rod extends and a movable part adapted to be inserted within said fixed part and means to fix said parts relative to each other, an outlet in said fixed part for the dosed liquid, an inlet controlled by a non-return valve in said movable part, the piston having a diameter corresponding to that of the movable part and said piston comprising a non-return valve.

2. A variable dosing piston pump, as claimed in claim 1, wherein the non-return valve piston including an annular elastic slanted skirt disposed at the periphery of the piston, said skirt constituting a seal for the piston.

3. A variable dosing piston pump as claimed in claim 1, wherein the non-return valve piston includes a check-valve within the piston and a O-ring seal disposed on the periphery of the piston.

4. A variable dosing piston pump as claimed in claim 1 including a threaded annular flanged connector screwed onto said fixed part with a seal held by the flange to said movable part so that the parts are fixed in position relative to each other.

* * * * *